United States Patent [19]

Doskocil

[11] 3,999,657

[45] Dec. 28, 1976

[54] GARMENT SHIPPING CARTON

[76] Inventor: Clarence E. Doskocil, Rte. 2 Box 82K, Mansfield, Tex. 76063

[22] Filed: Jan. 15, 1976

[21] Appl. No.: 649,658

[52] U.S. Cl. ..... 206/289; 206/491; 229/38; 229/45 R

[51] Int. Cl.[2] ..... B65D 85/18

[58] Field of Search ..... 206/289, 290, 291, 278, 206/280, 491; 229/38, 45

[56] References Cited

UNITED STATES PATENTS

| | | | |
|---|---|---|---|
| 647,897 | 4/1900 | Kramer | 229/38 |
| 1,141,489 | 6/1915 | Richardson | 229/38 |
| 1,614,843 | 1/1927 | Meller | 229/38 |
| 2,883,042 | 4/1959 | Richer | 206/291 |
| 3,139,978 | 7/1964 | Moglia | 206/291 |
| 3,360,113 | 12/1967 | Bower | 206/290 |

*Primary Examiner*—William T. Dixson, Jr.

*Attorney, Agent, or Firm*—Wofford, Felsman, Fails & Zobal

[57] ABSTRACT

A garment shipping carton for carrying garments on hangers, having four walls and a closed bottom. The top may be opened or closed by foldable flaps. Three of the four flaps have two apertures for the insertion of a hanger hook and for support of the hanger. One of the three flaps is supported in a closed position by supporting tabs on its edge that insert into apertures in the opposite wall. The other two flaps in closed position rest on top of the supporting flap. The fourth flap has no apertures and folds over the other three to prevent the hangers from dislodging. Locking tabs on its edge insert within apertures in the opposite wall to hold the flap in place.

11 Claims, 6 Drawing Figures

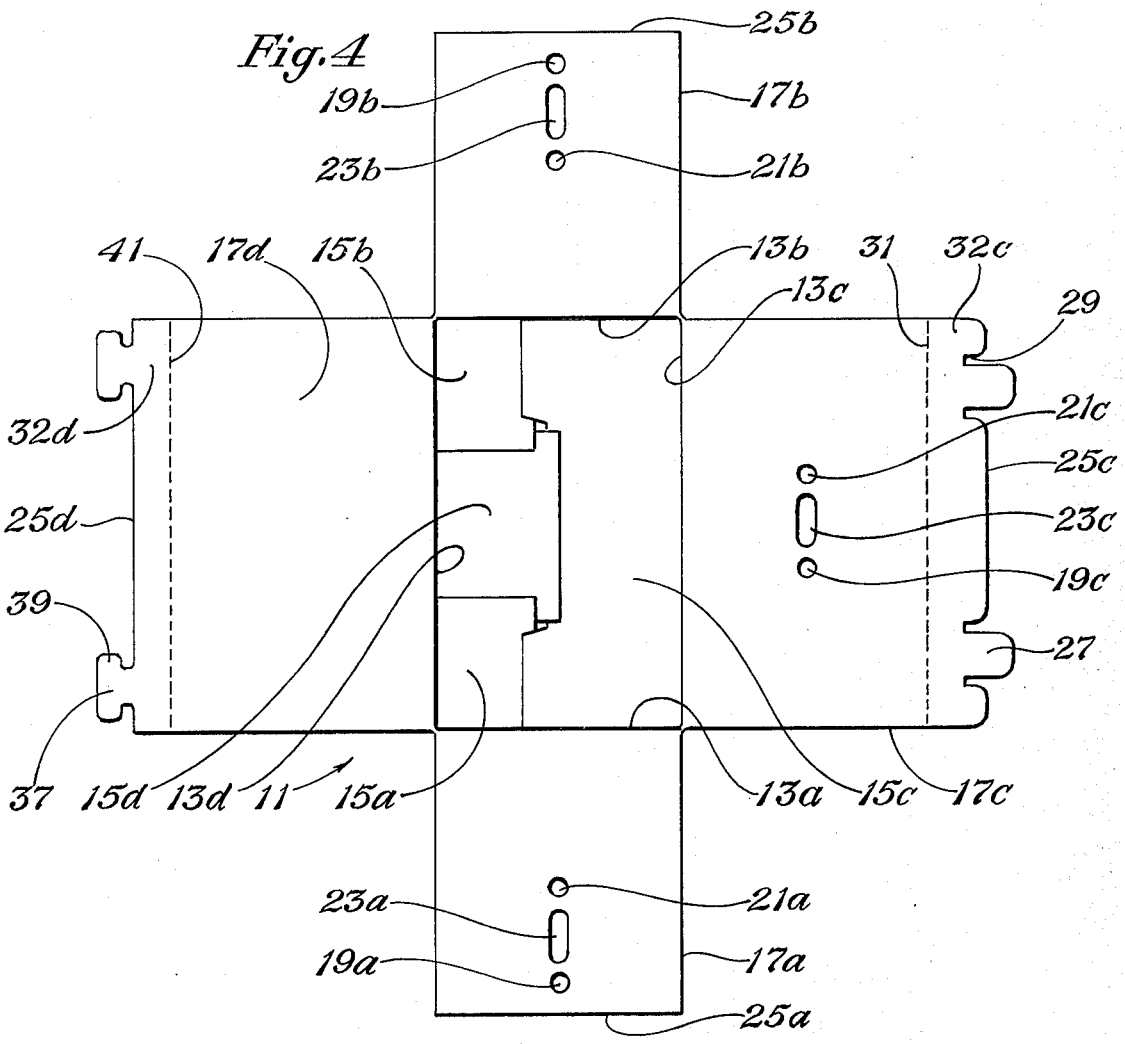
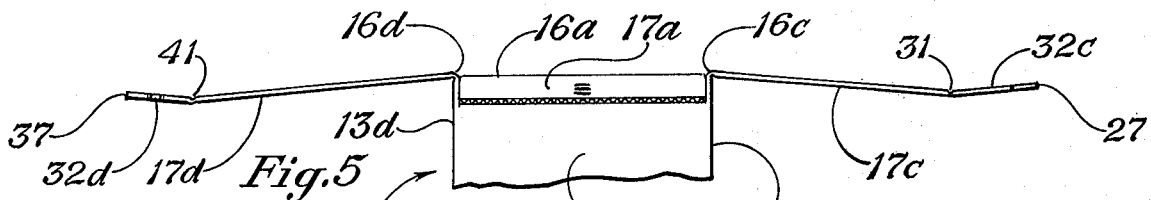
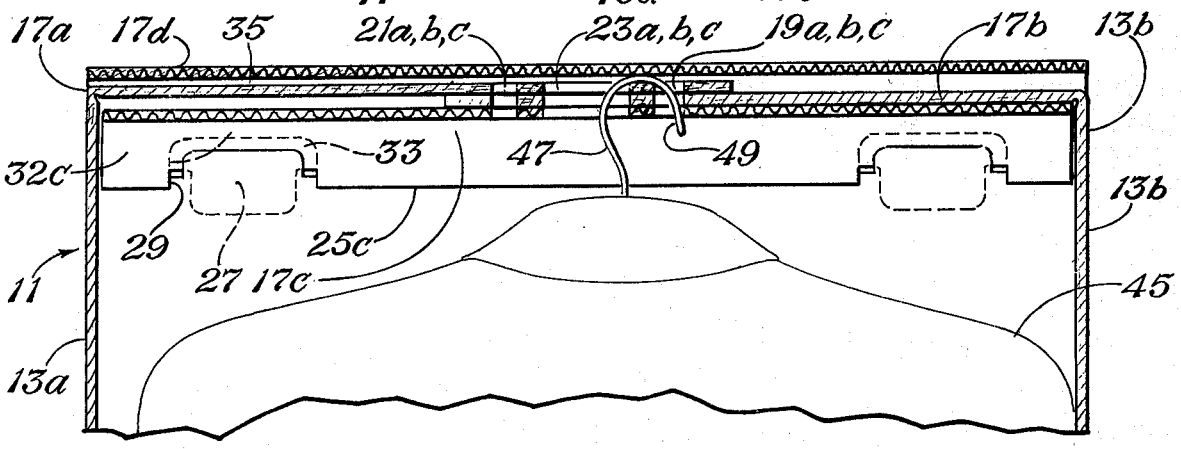
Fig. 6

GARMENT SHIPPING CARTON

BACKGROUND OF THE INVENTION

1. Field of the Invention

This invention relates in general to shipping containers and in particular to a carton for carrying garments on hangers.

2. Description of the Prior Art

Passengers on airlines frequently carry clothes on hangers, normally enclosed within flexible garment bags. The bags are usually plastic and have an aperture at the top for the hanger hooks to extend. Unless suspended by the hangers, the bag will collapse and the clothes may wrinkle. Often a passenger desires to "check" his garment bag, as opposed to carrying it himself on the plane. Transferring the garment bag to the loading section of the airport and into the storage area of the plane efficiently and without wrinkling the clothes is a difficult task. One practice is to simply place the garment bag in a rectangular cardboard box, however wrinkling of the clothes may occur since the garment bag is not supported by the hangers.

Shipping cartons that will support clothes on hangers are known in the art, although not normally used for airline passenger service. One such carton is described in U.S. Pat. No. 3,565,242. Frequently these cartons have separate supporting bars, which may be metal, and frequently the cartons are complex and difficult to assemble. For airline use, it is desirable that the cartons be of a single piece and collapse flat, to save storage space. The cartons must be easily and quickly foldable into operable position, and preferably not require any adhesive tape.

SUMMARY OF THE INVENTION

It is accordingly a general object of this invention to provide an improved garment shipping carton.

It is a further object of this invention to provide an improved garment shipping carton that is foldable quickly and easily into operable position from a single piece of material.

In accordance with these objects, a four-sided, collapsible carton is provided that supports garments on hangers. Each wall has a foldable flap depending from the upper end. Three of the flaps have two apertures for the insertion and support of the hangers. When the flaps are closed, the apertures align so that all three flaps aid in supporting the hangers. The lowermost flap is supported in a closed position by supporting tabs on its edge that insert in apertures on the opposite wall. A fourth flap covers the other three flaps, locking the hangers in place. The fourth flap has locking tabs that insert in the opposite wall.

BRIEF DESCRIPTION OF THE DRAWINGS

FIG. 4 is a reduced top plane view of the carton of FIG. 1 with the flaps in open position.

FIG. 5 is a reduced, partial elevational view of the carton of FIG. 1 with the flaps in open position.

FIG. 6 is an enlarged, cross-sectional view of the carton of FIG. 1 along the lines VI—VI.

DESCRIPTION OF THE PREFERRED EMBODIMENT

Figure 1:
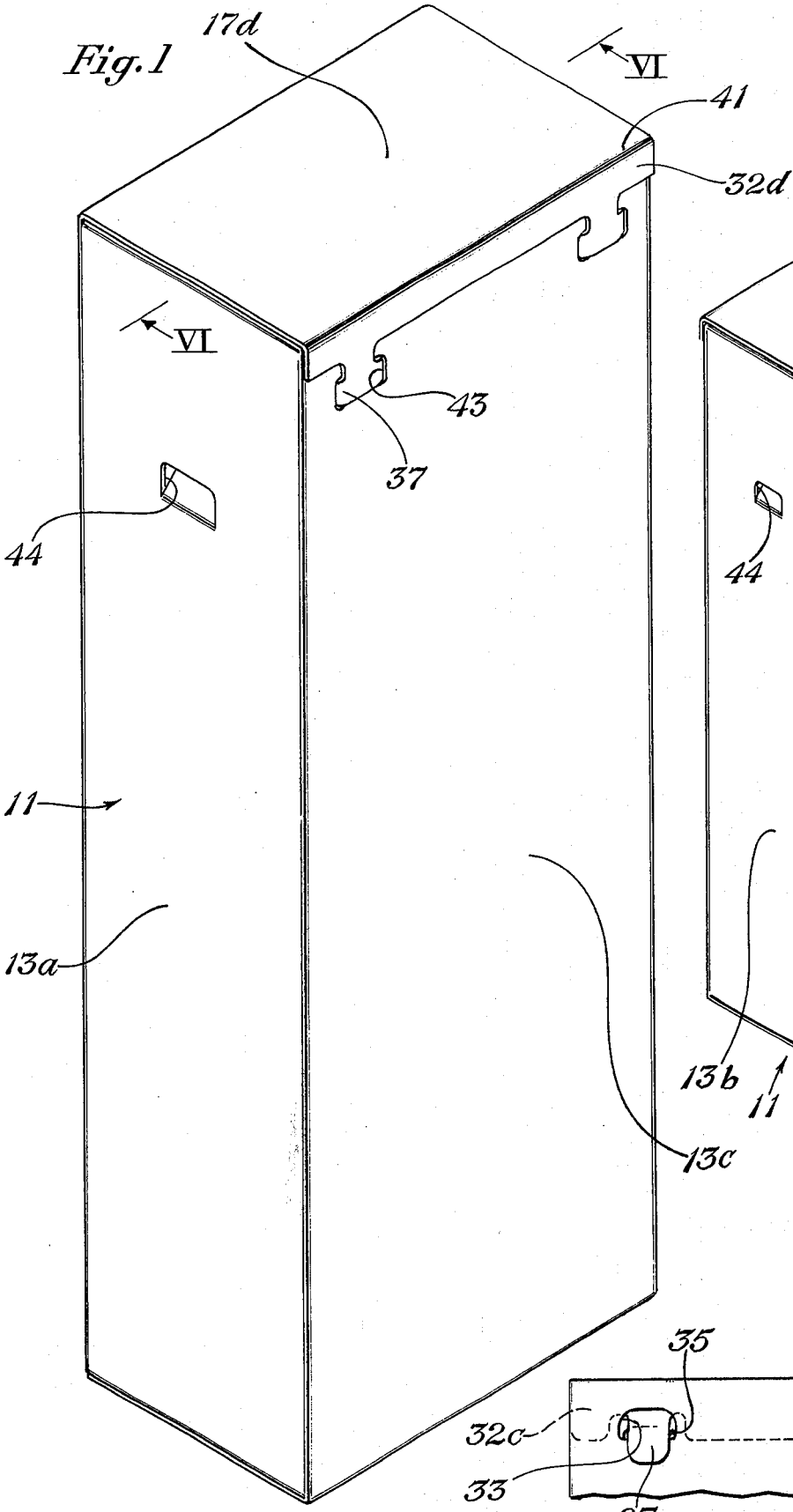
FIG. 1 is an isometric view of the carton in accordance with this invention.
Figure 2:
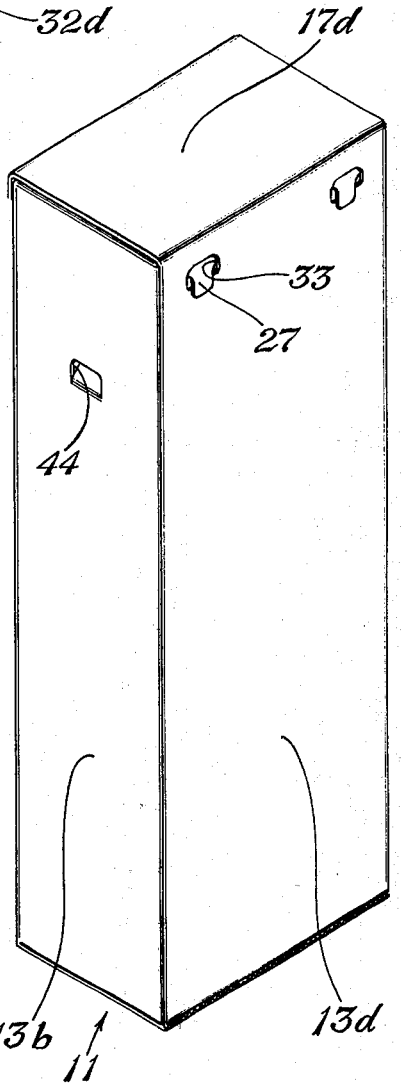
FIG. 2 is a reduced isometric view of the carton of FIG. 1, viewed from the side opposite that shown in FIG. 1.

Referring to FIGS. 1 and 2, a garment shipping carton 11 is shown in closed position. The carton is rectangular, with four walls 13*a*, *b*, *c*, *d*, and a closed bottom. The carton 11 is a single piece of carton material, such as cardboard with creases at the desired folding lines. The carton has flaps 15*a*, *b*, *c*, *d* at the bottom of the walls 13*a*, *b*, *c*, *d*, that fold in a known manner in the art, to form a closed bottom. The walls are joined permanently to each other by staples at one corner, but will collapse to a flat position.

Referring to FIGS. 4 and 5, the upper edges 16*a*, *b*, *c*, *d* of the walls 13*a*, *b*, *c*, *d* each have a flap 17*a*, *b*, *c*, *d* extending therefrom respectively. The flaps are foldable from an open position as in FIGS. 4 and 5 to a closed position, as in FIG. 6. Flaps 17*a*, *b*, which depend from walls 13*a*, *b* respectively, are rectangular and are of a length sufficient to extend past the center of the carton. Each flap has three apertures including two circular apertures 19*a*, *b*, 21*a*, *b*, and a slot 23*a*, *b*. The slots 23*a*, *b* extend perpendicularly to walls 13*a*, *b*. One of the circular apertures 19*a*, *b*, 21*a*, *b*, is on each side of the slot 23*a*, *b*. The apertures and slots are located adjacent the outer edge 25*a*, *b* of flaps 13*a*, *b*, and placed so that if the flaps are in closed position, circular apertures on one flap will align with the circular apertures on the other, and the slot on one flap will align with the slot on the other, as shown in FIG. 6.

The third flap 17*c* depends from the third wall 13*c* and is of a length such that it will extend to the fourth wall, 13*d*. Flap 17*c* is the main supporting flap, having supporting tabs 27 on its outer edge 25*c*. The supporting tabs 27 serve as supporting means for supporting the flap in closed position, as shown in FIG. 6. Tabs 27 are substantially rectangular pieces of carton material that are integral with the carton and extend further than the remainder of outer edge 25*c*. A channel 29 is cut a short distance on each side of the tabs to increase their effective length. A crease 31 is formed in flap 17*c* parallel to wall 13*c* and adjacent the outer edge 25*c*. The crease allows the end portion 32*c* of the flap 17*c* to fold over, so that in closed position, the supporting tabs 27 may be in a position parallel to walls 13*c*, *d*.

Figure 3:
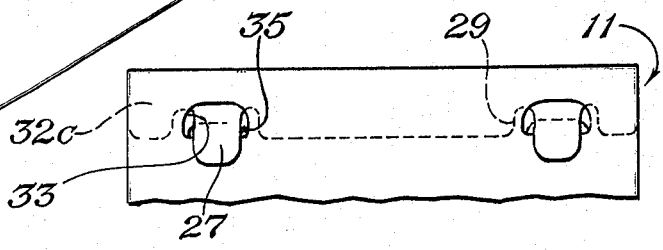
FIG. 3 is a reduced, partial elevational view of the carton of FIG. 1, viewed from the side shown in FIG. 2.

When in closed position, the supporting tabs are inserted within apertures 33, FIG. 3, adjacent the upper edge 16*d* of wall 13*d*. In closed position, outer edge 25*c* will be on the interior of the carton with the supporting tabs 27 extending from the inside out through apertures 33. Apertures 33 are slightly larger than the supporting tabs 27 and have channels 35 that mate with channels 29 for more effective support. Flap 17*c* also has three apertures 19*c*, 21*c* and 23*c* near its center that align with corresponding three apertures of flaps 17*a*, *b*, *c* as shown in FIG. 6 when closed.

Flaps 17*d* is a cover flap and it depends from wall 13*d*. The length of flap 17*d* is sufficient for it to extend slightly past wall 13*c*. Locking tabs 37 extend from its outer edge 25*d* and serve as locking means for locking flaps 17*d* in closed position over flaps 17*a*, *b*, *c*, as shown in FIG. 1. Locking tabs 37 have ears 39 extending slightly outward on each side of the tabs to restrain the tabs from pulling out of their mating apertures. A crease 51 is formed in flap 17*d* adjacent outer edge 17*d* and parallel to wall 13*d*. The crease enables the end portion 32*d* of flaps 17*d* to fold over so that in closed position, the locking tabs 37 may be in a position parallel to walls 13*c*, *d*, as shown in FIG. 1.

When in closed position, locking tabs 37 are inserted within apertures 43, FIG. 1, adjacent the upper edge 16*c* of wall 13*c*. In closed position, outer edge 25*d* will be on the exterior of the carton, with locking tabs 37 extending from the outside in through apertures 43 to the interior of the carton. Apertures 43 are rectangular and of a width slightly less than the width across the ears 39 of locking tab 37, so that the ears must be bent before the tab can enter. Once inserted, the ears 39 tend to return to the normal planar configuration of the tab 37, preventing the withdrawal of the tab unless a substantial force is exerted. Since flap 17*d* is the cover flap, it does not have any apertures. An aperture 44 is provided in walls 13*a*, *b*, for providing a handle for gripping the carton.

In operation, the carton 11 is normally initially collapsed. A user draws the walls 13 into a generally rectangular configuration, then places the bottom flaps in proper position to define an open topped rectangular box. A garment bag 45, FIG. 6, is then placed into the interior of the carton. The coat hanger hook 47 is then inserted up through slot 23*c* as supporting flap 17*c* is being closed. While holding the hanger hook 47 with one hand, the user presses supporting tabs 27 down through their mating apertures 33. The hook 47 is then inserted through slots 23*a*, *b* of flap 17*a*, *b* as they are folded into closed position. Flap 17*a* may be on top of 17*b* or vice versa. The hook hanger 47 is then lowered and placed on the flaps, with the point 49 inserted down into either circular apertures 19*a*, *b*, *c* or 21*a*, *b*, *c*. Having two circular apertures allows one to place the hooks 47 in the opposite direction should the portion between the slot and one of the circular apertures become deteriorated from use. The cover flap 17*d* is then folded over the other three flaps, and the locking tabs 37 forced through their mating apertures 43. The cover flap prevents the hanger from dislodging or falling from the apertures should the carton be placed in a position other than upright. The walls 17*c*, *d* are wider than walls 17*a*, *b*, being approximately the width of a garment bag. The hangers will be parallel to the walls 17*c*, *d*.

It is accordingly seen that an invention having significant improvements has been provided. The garment shipping carton is particularly adaptable for use by airlines since it utilizes single piece construction with no additional parts or taping required. The carton folds quickly and easily from a collapsed state. It can be used to hold other objects as well, such as guitars or backpacks.

It is understood that the present disclosure has been made only by way of example and that numerous changes in the details of construction may be resorted to without departing from the spirit or the scope of this invention.

I claim:

1. A garment shipping carton for transporting garments carried on hangers, comprising:

first and second walls on opposite sides of the carton;

first and second flaps, each depending foldably from the top edges of the first and second walls respectively; each flap having two apertures adjacent each other for the insertion and suspension of a hanger; the apertures being located so that the apertures in one flap are aligned with the apertures in the other flap when the flaps are in a closed position;

third and fourth walls on opposite sides of the carton and connecting the first and second walls together;

a third flap depending foldably from the top edge of the third wall; the third flap having two apertures adjacent each other for the insertion and suspension of a hanger; the apertures being located so that they are in alignment with the apertures of the first and second flaps when the first, second and third flaps are folded in closed position;

supporting means for supporting the third flap in closed position;

a fourth flap depending foldably from the top edge of the fourth wall; and locking means for locking the fourth flap over the first, second and third flaps when in closed position;

whereby a support for hanging garments by hangers is provided by the first, second and third flaps, with the fourth flap providing a covering to prevent hangers from being dislodged.

2. The garment shipping carton according to claim 1 wherein the supporting means comprises at least one supporting tab extending from the third flap for insertion within an aperture provided therefor adjacent the upper edge of the fourth wall.

3. The garment shipping container according to claim 1 wherein:

the locking means comprises at least one locking tab extending from the fourth flap for insertion within an aperture provided therefor adjacent the upper edge of the third wall.

4. A garment shipping carton for transporting garments carried on hangers, comprising:

first and second walls on opposite sides of the carton;

first and second flaps, each depending foldably from the top edges of the first and second walls respectively; each flap having two apertures adjacent each other for the insertion and suspension of a hanger; the apertures being located so that the apertures in one flap are aligned with the apertures in the other flap when the flaps are folded in closed position;

third and fourth walls, on opposite sides of the carton, connecting the first and second walls together; each third and fourth wall having at least one aperture adjacent its upper edge;

a third flap depending foldably from the top edge of the third wall and having at least one supporting tab; the third flap being foldable adjacent the supporting tab for insertion of the supporting tab in the aperture in the fourth wall; the third flap having two apertures for the insertion and suspension of a hanger; the apertures being located so that they are in alignment with the apertures of the first and second flaps when the first, second and third flaps are folded in closed position; and a fourth flap depending foldably from the top edge of the fourth wall and having at least one locking tab; the fourth flap being foldable adjacent the locking tab for insertion of the locking tab in the aperture in the third wall;

whereby a support for hanging garments by hangers is provided by the first, second, and third flaps, with the fourth flap providing a covering to prevent hangers from being dislodged.

5. The garment shipping carton according to claim 4 wherein the two apertures located on the first, second and third flaps comprise an elongated slot for ease in inserting the hook of the hanger from the inside of the carton, and a first circular aperture for the insertion of the point of the hook of the hanger from the outside of the carton.

6. The garment shipping carton according to claim 5, further comprising a second circular aperture located on the opposite end of each slot from the first circular aperture, to allow the hook point of the hanger to be placed in either aperture.

7. The garment shipping container according to claim 4 wherein the third flap has two supporting tabs, and the fourth wall has two apertures for the insertion therein; and the fourth flap has two locking tabs with the third wall having two apertures for insertion therein.

8. The garment shipping container according to claim 7 wherein the locking tabs each have ears on both sides that are larger than the respective mating apertures of the locking tabs, for preventing the locking tabs from dislodging.

9. The garment shipping carton according to claim 4 wherein the first and second walls each have an aperture for providing a means to grip and carry the carton.

10. The garment shipping container according to claim 4 wherein the material forming the carton is cardboard.

11. The garment shipping container according to claim 4 wherein the first, second, third and fourth walls are rectangular.

* * * * *